US008414334B2

(12) United States Patent
Nakayama et al.

(10) Patent No.: US 8,414,334 B2
(45) Date of Patent: Apr. 9, 2013

(54) HOLDER-MOUNTING STRUCTURE

(75) Inventors: Makoto Nakayama, Kakegawa (JP); Takahiko Mitsui, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 50 days.

(21) Appl. No.: 13/064,370

(22) Filed: Mar. 22, 2011

(65) Prior Publication Data

US 2011/0237129 A1 Sep. 29, 2011

(30) Foreign Application Priority Data

Mar. 26, 2010 (JP) ..... 2010-072776

(51) Int. Cl.
*H01R 13/66* (2006.01)

(52) U.S. Cl.
USPC ..... 439/620.01

(58) Field of Classification Search ..... 439/620.01, 439/366, 696–698, 76.2, 441, 373–375, 489
See application file for complete search history.

(56) References Cited

U.S. PATENT DOCUMENTS 5,171,293 A * 12/1992 Umemoto et al. ..... 439/620.33
5,277,626 A 1/1994 Oikawa et al.
5,632,654 A * 5/1997 Sugiura ..... 439/620.26
5,751,208 A * 5/1998 Martinez ..... 337/198
5,816,858 A * 10/1998 Kazarian et al. ..... 439/620.26
6,033,252 A * 3/2000 Hood et al. ..... 439/374
6,875,028 B2 * 4/2005 Kita et al. ..... 439/76.2
7,612,646 B2 * 11/2009 Kubota ..... 337/186

FOREIGN PATENT DOCUMENTS

JP 05-159693 A 6/1993

* cited by examiner

*Primary Examiner* — Jean F Duverne
(74) *Attorney, Agent, or Firm* — Edwards Wildman Palmer LLP

(57) ABSTRACT

A holder-mounting structure comprises a holder and a holder mounting portion into which the holder is slidably inserted. The holder includes a holder body for mounting of an electric component and a pair of plate portions extending from the holder body such that the electric component resides therebetween. The plate portions include a thick-walled portion continuing to the holder body and a thin-walled portion continuing to the thick-walled portion and provided at an end of the plate portion away from the holder body. The holder mounting portion includes an accommodating portion into which a connecting terminal connected to the electric component is accommodated. The thin-walled portion includes a complete-locking portion configured to be brought into locking engagement with the holder at a position where the electric component is connected to the connecting terminal with the holder slidably inserted into the accommodating portion.

9 Claims, 6 Drawing Sheets

HOLDER-MOUNTING STRUCTURE

CROSS-REFERENCE TO RELATED APPLICATION

This application is related to co-pending application: "COMPONENT-EQUIPPED-HOLDER MOUNTING STRUCTURE" filed concurrently herewith in the names of Makoto Nakayama and Takahiko Mitsui, which application is assigned to the assignee of the instant application and is incorporated by reference herein.

This application claims priority to Japanese Patent Application No. 2010-072776, filed on Mar. 26, 2010, which is incorporated by reference herein.

BACKGROUND OF THE INVENTION

1. Field of the Invention

The present invention generally relates to a structure configured for mounting a holder to an electrical junction box, and in particular to a holder-mounting structure configured for mounting a holder, to which an electric component is attached, on a holder mounting portion provided in an electrical junction box.

2. Description of Related Art

FIG. 10 illustrates a conventional holder-mounting structure 101. The holder-mounting structure 101 is configured for mounting (A) a holder 102 to (B) a holder mounting portion 105 provided in an electrical junction box. In the figure, a dark-current fuse 115 is attached to the holder 102. The dark-current fuse 115 is a known in-between component connected both to a dark-current component and a power source that deliver electrical power to the dark-current component, the dark-current component may comprise a component having a clock function that has to be kept active even when an ignition is turned off.

A known holder-mounting structure of this type is disclosed, for example, in Japanese Patent Application Laid-Open Publication No. H05-159693.

As shown in FIG. 10, the holder 102 comprises (a) a holder body 103 in a shape of a box defined by a top wall 109 and side walls 110 continuing to the peripheral portion of the top wall 109; and (b) a pair of locking wall portions 104 protruding from the side walls 110 in a shape of a plate such that the locking wall portions 104 are spaced from each other and from the top wall 109. The dark-current fuse 115 is attached to the holder body 103.

The pair of locking wall portions 104 each include (i) a provisional-locking portion 111 and (ii) a complete-locking portion 112 closer to a top of the locking wall portion 104 than the provisional-locking portion 111 is. In FIG. 10, the arrow Y represents a direction in which the locking wall portion 104 extend from the top wall 109, and the arrow X represents a direction in which the pair of locking wall portions 104 are arranged.

Still referring to FIG. 10, the holder mounting portion 105 comprises (a) a mounting portion body 106 in a shape of a box defined by a bottom wall and side walls 114; (b) a pair of provisional-locking arms 107 extending from the bottom wall in the direction indicated by the arrow Y and adapted to be elastically deformable in the direction indicated by the arrow X; and (c) a pair of complete-locking arm 108 extending from the bottom wall in the direction indicated by the arrow Y and adapted to be elastically deformable in the direction indicated by the arrow X. The provisional-locking arms 107 and the complete-locking arms 108 are provided such that each of the locking wall portions 104 resides in-between, i.e., sandwiched by the provisional-locking arm 107 and the complete-locking arm 108 in the direction indicated by the arrow X. The provisional-locking arm 107 includes a provisional-locking engagement portion 116 configured to be brought into locking engagement with the provisional-locking portion 111. The complete-locking arm 108 includes a complete-locking engagement portion 117 configured to be brought into locking engagement with the complete-locking portion 112. The locking arms 107, 108 have a uniform thickness from an end continuing to the bottom wall to the other end away from the bottom wall in the direction indicated by the arrow X. Also, the mounting portion body 106 includes a female terminal 118 connected to the power source and circuits of various electronic components.

Operation for mounting the conventional holder 102 to the holder mounting portion 105 can be described as follows. First, the dark-current fuse 115 is attached to the holder body 103. Next, the holder 102 is moved close to the holder mounting portion 105 such that the pair of locking wall portions 104 enter a space between the pair of provisional-locking arms 107 until the provisional-locking engagement portion 116 is brought into locking engagement with the provisional-locking portion 111. In this state of locking engagement, the dark-current fuse 115 and the female terminal 118 are spaced from each other and is electrically disconnected from each other. The holder 102 is further moved close to the holder mounting portion 105 until the complete-locking engagement portion 117 is brought into locking engagement with the complete-locking portion 112. In this manner, when the complete-locking engagement portion 117 is in locking engagement with the complete-locking portion 112, the dark-current fuse 115 and the female terminal 118 are electrically connected to each other.

As the number of electronic devices incorporated in an automobile has been increasing in recent years, electric junction boxes, which incorporates various electric components, need to have spaces for a mechanism of electrical connection and disconnection of the dark-current fuse 115.

To address such a current trend, the thickness of the entire locking arms 107, 108 (in the direction indicated by the arrow X) may be reduced for making the holder mounting portion 105 more low-profile and providing a space for mounting of the electric component. However, uniform reduction in the thickness of the locking arms 107, 108 can cause the locking arms 107, 108 to be bent or broken, which makes it difficult to ensure sufficient mechanical strength of the locking arms 107, 108 that have to reliably hold the holder 102.

In contrast, a uniformly increased thickness of the locking arms 107, 108 to ensure a desired mechanical strength often results in a larger size and dimension of the holder mounting portion 105 (in the direction indicated by the arrow X). In other words, a conventional low-profile or miniaturized holder-mounting structure 101 would fail to ensure mechanical strength of the locking arms 107, 108 needed to hold the holder 102.

In addition, the provisional-locking arms 107 and the complete-locking arms 108 of in the conventional holder-mounting structure 101 are arranged in alignment with each other in the direction indicated by the arrow X. This means that these locking arms 107, 108 are elastically deformed in the same direction (i.e., the direction indicated by the arrow X), which in turn means that the conventional holder-mounting structure 101 becomes further larger in size.

SUMMARY OF THE INVENTION

In view of the above-identified drawbacks, an object of the present invention is to provide a holder-mounting structure that realizes two features that often do not go together, i.e., ensuring sufficient level of mechanical strength and making the product thinner and more low-profile.

According to a first aspect of the present invention, there is provided a holder-mounting structure that comprises (a) a holder and (b) a holder mounting portion into which the holder is slidably inserted.

The holder includes a holder body to which an electric component is attached, and a pair of plate portions extending from the holder body such that the electric component is disposed between the plate portions.

The plate portions each includes a thick-walled portion continuing to the holder body and a thin-walled portion continuing to the thick-walled portion and provided at an end of the plate portion away from the holder body. The thin-walled portion is thinner than the thick-walled portion. The thin-walled portion includes a complete-locking portion configured to be brought into locking engagement with the holder.

The holder mounting portion includes an accommodating portion into which a connecting terminal to be connected to the electric component is accommodated, wherein the complete-locking portion of the thin-walled portion is brought into locking engagement with the holder at a position where the electric component is connected to the connecting terminal with the holder slidably inserted into the accommodating portion.

Some objects, features and advantages of the present invention include: providing the low-profile holder-mounting structure; increased mechanical strength of the plate portion; providing the holder-mounting structure that is made low-profiled in the second direction; providing improved mechanical strength of the arm portion; prevention of unstable contact between the holder and the holder mounting portion by virtue of abutment of the arm portion on the outer surface.

Other objects, features, and advantages of the present invention will be apparent in view of this disclosure to those skilled in the art.

BRIEF DESCRIPTION OF THE DRAWINGS

In order that the present invention can be fully understood, an exemplary embodiment thereof will now be described with reference to the accompanying drawings, in which.

DETAILED DESCRIPTION OF THE EXEMPLARY EMBODIMENT

A holder-mounting structure 1 according to one embodiment of the present invention is described with reference to FIGS. 1 to 8.

Figure 1:
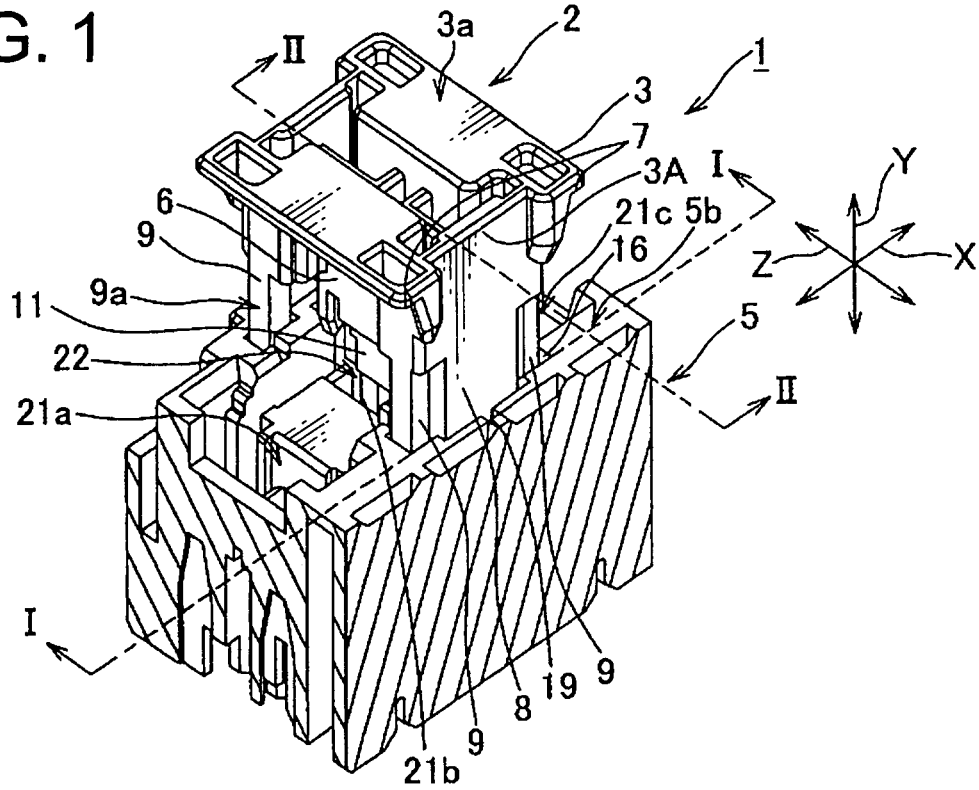
FIG. 1 is a perspective view of the holder-mounting structure according to one embodiment of the present invention in a state where a provisional-locking portion is in locking engagement with the provisional-locking engagement portion.
Figure 2:
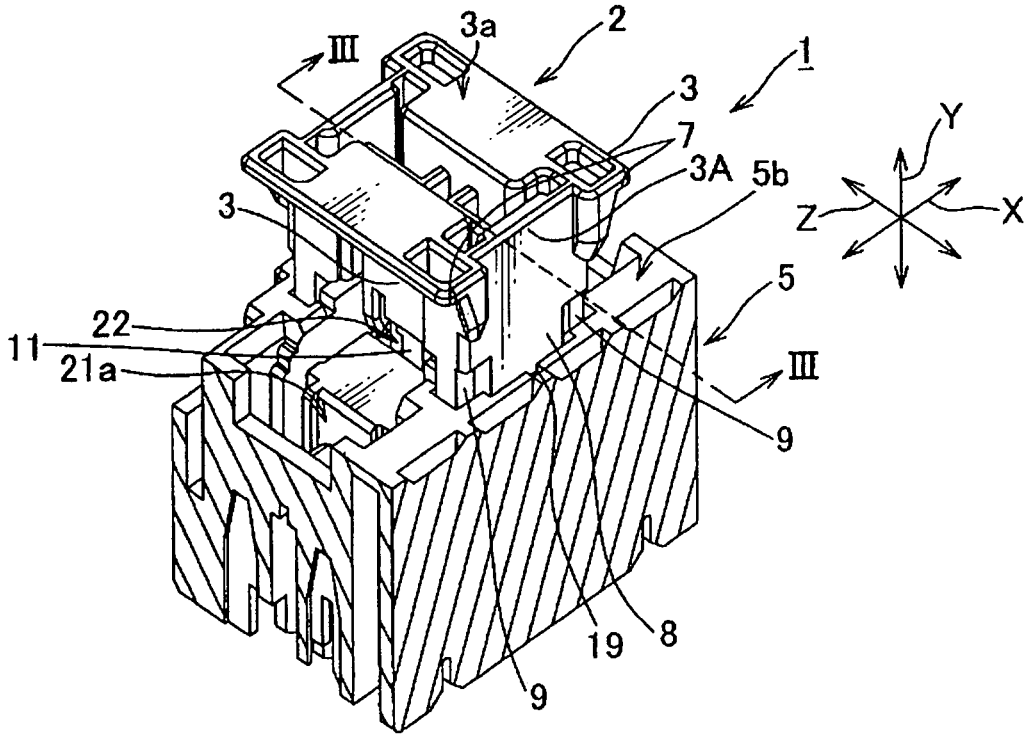
FIG. 2 is a perspective view of the holder-mounting structure illustrated in FIG. 1 in a state where a complete-locking portion is in locking engagement with a complete-locking engagement portion.

Referring to FIGS. 1 and 2, the holder mounting structure 1 according to this embodiment comprises (A) a holder 2 to which an electric component such as a fuse 11 is attached, and (B) a holder mounting portion 5 that includes an accommodating portion 22 into which the holder 2 is slidably inserted. The holder mounting portion 5 is provided in an electrical junction box disposed in an automobile.

The fuse 11 may be provided between a dark-current component and a power source and connected to them. The dark-current component may comprise a component having a clock function that has to be kept active even when an ignition is turned off.

The fuse 11 is connected to and provided between the power source and the dark-current component and adapted to melt down to stop power supply to the dark-current component when an overcurrent from the power source flows in the dark-current component. In order to prevent running out of the battery of the automobile incorporating the fuse 11, the dark-current component is electrically disconnected from the power source while the fuse 11 connected to the dark-current component is transported (i.e., the holder 2, which will be described later, is positioned at the provisional-locking position of the holder mounting portion 5). When the automobile is delivered to a user, the fuse 11 is connected to the power source and the dark-current component so that the dark-current component is electrically connected to the power source.

Figure 3:
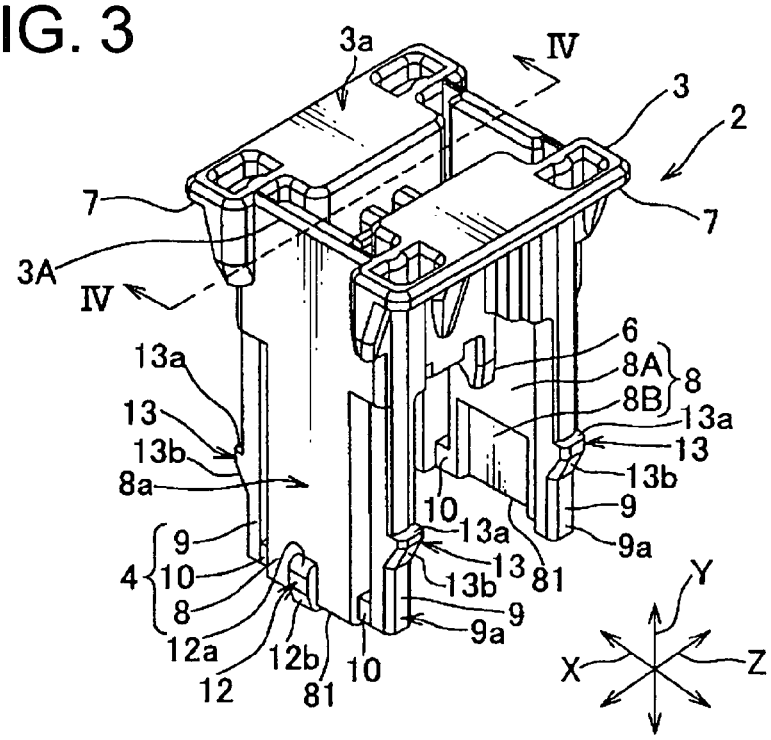
FIG. 3 is a perspective view serving as the holder-mounting structure illustrated in FIG. 1.

The holder 2 is made of insulating synthetic resin. Referring to FIG. 3, the holder 2 includes (a) a holder body 3 to which the fuse 11 is attached and (b) a pair of legs 4. It should be noted that the fuse 11 is not illustrated in FIG. 3.

The holder body 3 includes (i) a rectangular body portion 3A; (ii) a pair of clamping portions 6; and (iii) a pair of extended portions 7. A top surface 3*a* of the body portion 3A is flat.

The pair of clamping portions 6 protrude from the body portion 3A in the direction indicated by the arrow Y (hereafter referred to as "Y-direction"), spaced from each other, and opposed to each other in the direction indicated by the arrow X (hereafter referred to as "X-direction"). The pair of clamping portions 6 are configured to clamp the fuse 11 therebetween.

The pair of extended portions 7 is provided at both ends of the body portion 3A in the X-direction over an entire length in the direction indicated by the arrow Z (hereafter referred to as "Z-direction"). The pair of extended portions 7 each protrude in a direction away from corresponding each of both ends of the body portion 3A and in the X-direction. The extended portion 7 and the top surface 3*a* of the body portion 3A are flush with each other.

The pair of legs 4 in a shape of a plate is provided on the holder body 3. The pair of legs 4 include (i) a pair of plate portions 8 spaced from each other such that the fuse 11 is positioned therebetween; (ii) a pair of arm portions 9 each extending in a first direction (the Y-direction) and spaced from corresponding each of the plate portions 8 and aligned with the corresponding each of the plate portions 8 in a third direction (the X-direction); and (iii) a pair of connecting portions 10 adapted to connect each of the ends of the pair of the arm portion 9 on the side away from the holder body 3 to corresponding each of the plate portions 8. The third direction (the X-direction) is orthogonal to both the first direction (the Y-direction) in which the plate portions 8 extend and the second direction (the Z-direction) in which the pair of plate portions 8 are arranged.

Specifically, the arrow Y in the figures represents the direction in which the plate portions 8 extend from the holder body 3 (Y-direction). The Y-direction corresponds to the "first direction" in the context of the scope of protection.

The arrow Z in the figures represents the direction in which the pair of plate portions 8 are arranged (Z-direction), the Z-direction being orthogonal to (at right angles to) the Y-direction. The Z-direction corresponds to the "second direction" in the context of the scope of protection.

The arrow X in the figures represents a direction in which the arm portion 9 of the plate portion 8 is provided (X-direction), the X-direction orthogonal to (at right angles to) the Y- and Z-directions. The X-direction corresponds to the "third direction" in the context of the scope of protection.

Figure 4:
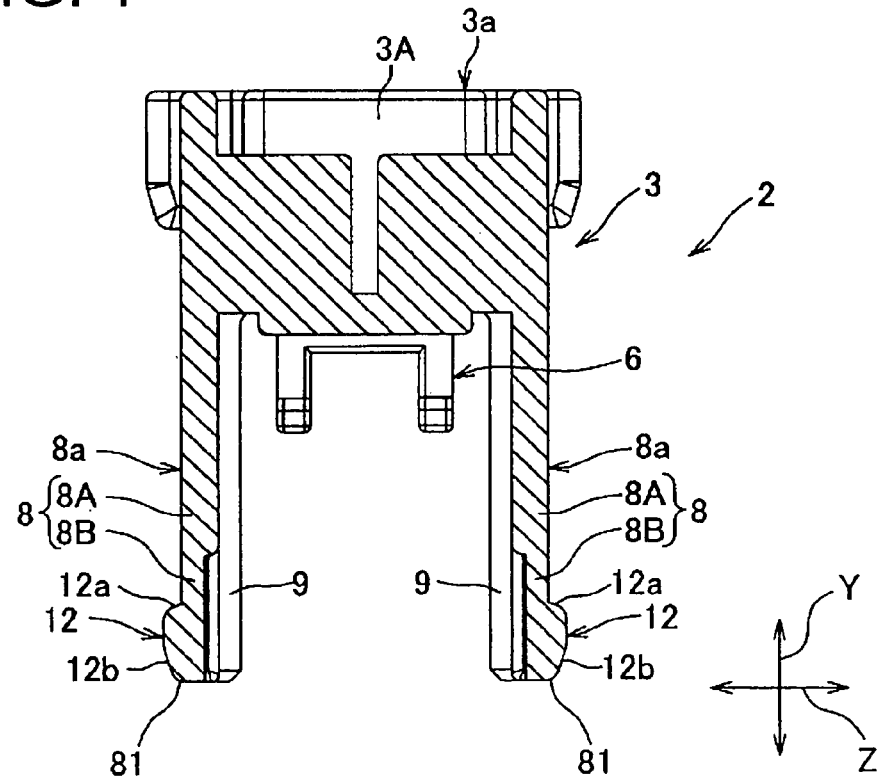
FIG. 4 is a cross-sectional view of the holder illustrated in FIG. 3 taken along the line IV-IV.

Referring to FIG. 4, the plate portion 8 includes (a) a thick-walled portion 8A continuing to the holder body 3, and (b) a thin-walled portion 8B continuing to the thick-walled portion 8A.

The thin-walled portions 8B extend along the mutually opposing surfaces of the pair of plate portions 8 in a shape of a recess depressed with reference to the opposing surfaces. Thickness of the thin-walled portion 8B (in the Z-direction) is reduced relative to the thick-walled portion 8A. The thin-walled portion 8B is provided at an end 81 of the plate portion 8 away from the holder body 3, and only provided at the central portion of the end 81 in the X-direction.

Since the thickness of the thin-walled portion 8B is reduced relative to that of the thick-walled portion 8A (in the Z-direction), the thin-walled portion 8B is more readily elastically deformed than the thick-walled portion 8A.

The thin-walled portion 8B includes a complete-locking portion 12 that protrudes from an outer surface 8*a* of the plate portion 8, the outer surface 8*a* being on the side away from the fuse 11.

The complete-locking portion 12 includes (i) a first tapering portion 12*a* slanted in a direction away from the outer surface 8*a* and in a direction from a proximal portion of the complete-locking portion 12 with respect to the holder body 3 and downward in the Y-direction; and (ii) a second tapering portion 12*b* slanted in the direction away from the outer surface 8*a* and in a direction from a distal portion of the complete-locking portion 12 away from the holder body 3 (i.e., the end 81 of the plate portion 8) and upward in the Y-direction. Obliquity of the second tapering portion 12*b* is gentler than that of the first tapering portion 12*a*.

The arm portion 9 has a rod-like shape. The arm portion 9 is adapted to be elastically deformable in the X-direction. One end of the arm portion 9 continues to the holder body 3 and the other end thereof is connected via the connecting portion 10 to the end 81 of the plate portion 8, so that the arm portion 9 is configured to be held at two points.

The arm portion 9 includes a provisional-locking portion 13. The provisional-locking portion 13 protrudes from an outer surface 9*a* of the arm portion 9 on the side away from the plate portion 8. Also, the provisional-locking portion 13 is provided at the central portion of the arm portion 9 in the direction indicated by the arrow Y, and is positioned closer to the holder body 3 than the complete-locking portion 12 is.

The provisional-locking portion 13 includes (i) a vertical surface 13*a* provided at an end of the provisional-locking portion 13 on the side of the holder body 3 and extending vertically with respect to the outer surface 9*a*; (ii) and a tapering portion 13*b* slanted in the direction away from the outer surface 9*a* and extending from a portion of the provisional-locking portion 13 on the side away from the holder body 3 upward in the Y-direction.

The electrical junction box is mounted in an automobile to distribute electrical power from the power source among electronic devices. The electrical junction box includes (i) a plurality of busbars adapted to connect the fuse 11, relay, and connector to each other in accordance with a predetermined pattern; (ii) a busbar mounting portion in a shape of a plate for mounting of the busbars, the busbar mounting portion being made of insulating synthetic resin; and (iii) a holder mounting portion 5 for mounting of the holder 2 to the busbar mounting portion 5.

Figure 5:
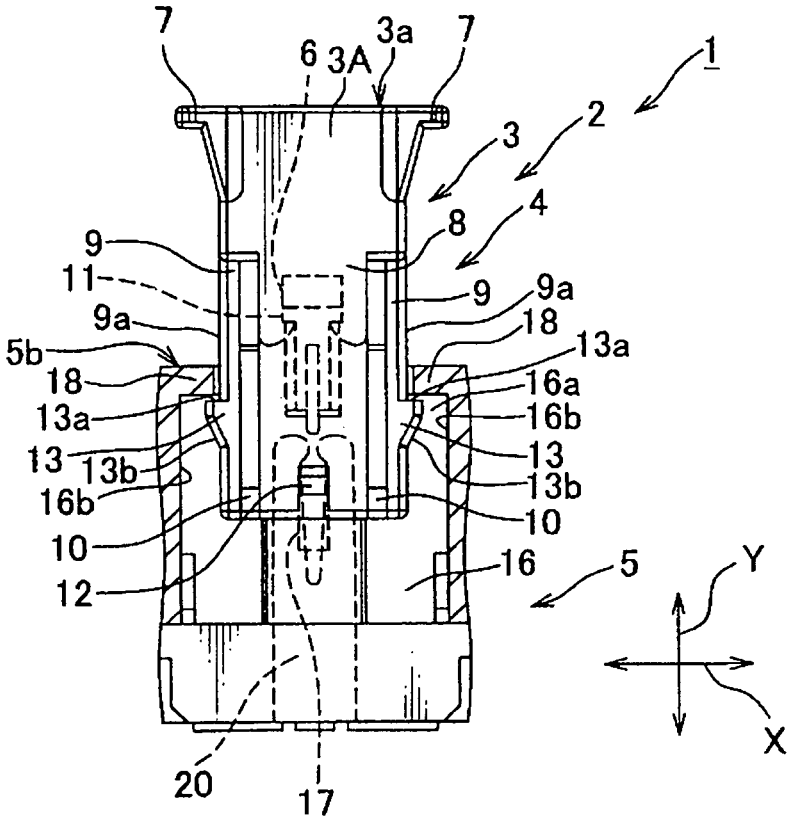
FIG. 5 is a cross-sectional view of the holder-mounting structure illustrated in FIG. 1 taken along the line I-I.

The busbar is made from a conductive metal plate with punching and bending provided as required. The busbar includes in one piece therewith, as shown in FIG. 5, the fuse 11, a relay, a connector and a plurality of tuning-fork-type terminals 20 adapted to connect them to each other. The tuning-fork-type terminal 20 upstands in the Y-direction. Also, the tuning-fork-type terminal 20 takes a shape of a tuning fork in plan view with a slit adapted to insert the fuse 11 therein.

The slit extends straight and forms a notch extending from the central portion of the tuning-fork-type terminal 20 in the Y-direction to an outer edge away from the busbar mounting portion. Also, the fuse 11 is adapted to be inserted into the slit to be brought elastically into contact with the tuning-fork-type terminal at an entrance portion of the slit, and thereby the fuse 11 is connected to the busbar. The tuning-fork-type terminal 20 corresponds to the "connecting terminal" in the context of scope of protection.

The busbar mounting portion includes a plurality of through-holes. With the tip of the tuning-fork-type terminal 20 passed through the through-hole, the tuning-fork-type terminal 20 is attached to the busbar mounting portion. Thus, the busbar mounting portion includes the tuning-fork-type terminal upstanding on the busbar mounting portion. Also, the busbar mounting portion includes a relay mounting portion for mounting of the relay and a connector mounting portion for mounting of the connector. The relay mounting portion and the connector mounting portion are provided in a shape of a frame complementary to the outer shapes of the relay and the connector that are attached to the relay mounting portion and the connector mounting portion. When the relay is attached to the relay mounting portion, the relay is electrically connected to the busbar. When the connector is attached to the connector mounting portion, then the connector is electrically connected to the busbar.

As shown in FIGS. 1 and 2, the holder mounting portion 5 is made of insulating synthetic resin and has a shape of the electrical junction box. The holder mounting portion 5 is disposed in an overlapping manner upon the busbar mounting portion. The holder mounting portion 5 includes an accommodating portion 22 into which the holder 2 is slidably inserted. It should be noted that FIGS. 1 and 2 illustrate part of the electrical junction box.

Figure 6:
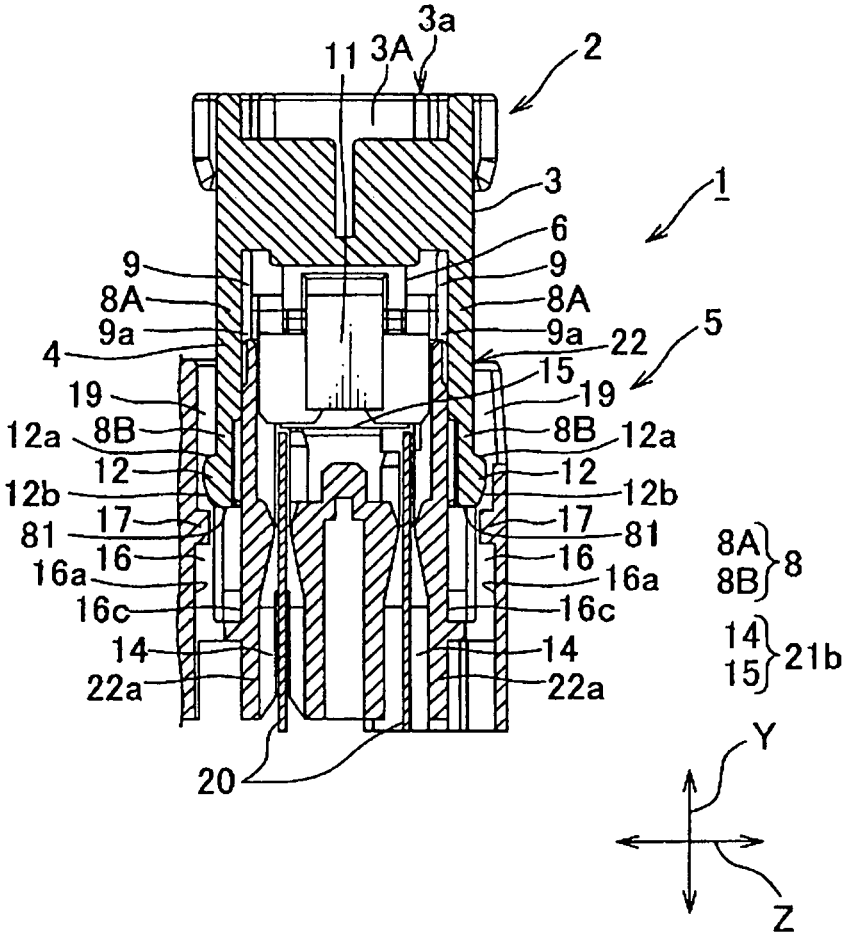
FIG. 6 is a cross-sectional view of the holder-mounting structure illustrated in FIG. 1 taken along the line II-II.
Figure 7:
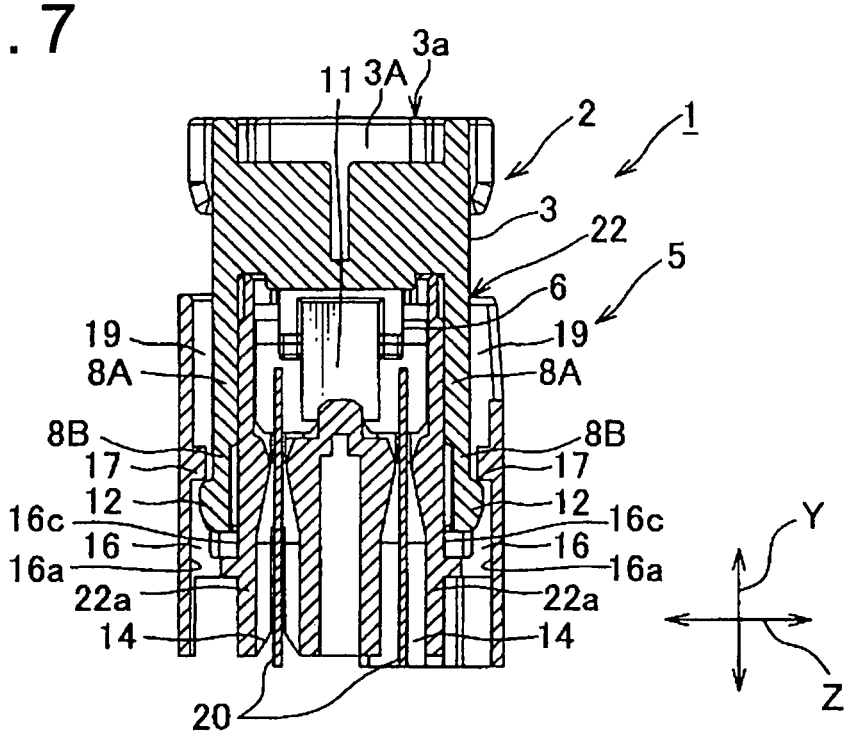
FIG. 7 is a cross-sectional view of the holder-mounting structure illustrated in FIG. 2 taken along the line III-III.
Figure 9:
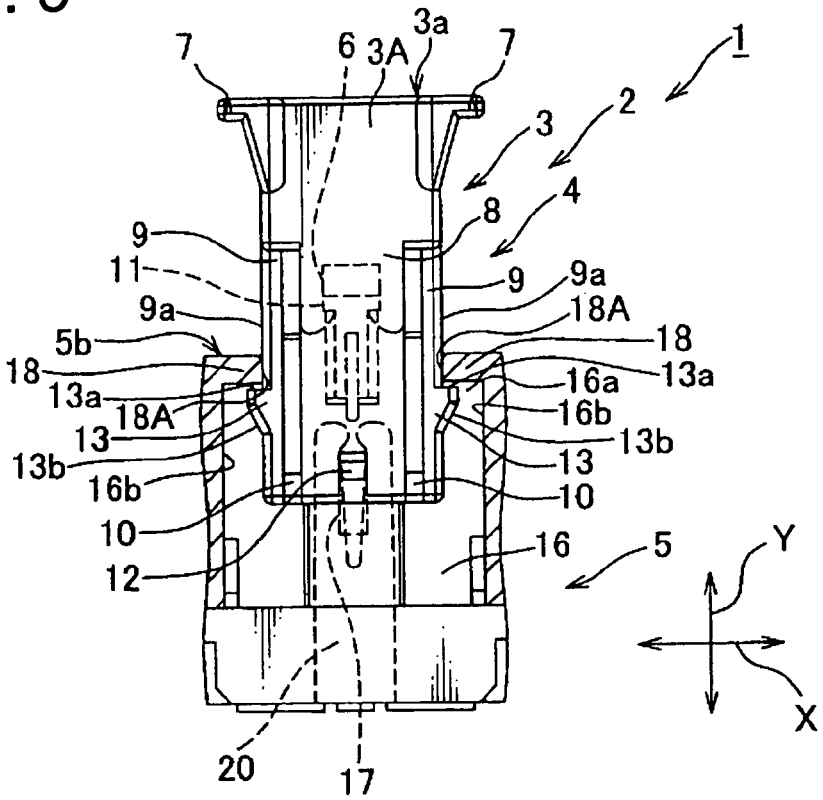
FIG. 9 is a cross-sectional view of another variation of the holder-mounting structure illustrated in FIG. 1.
Figure 10:
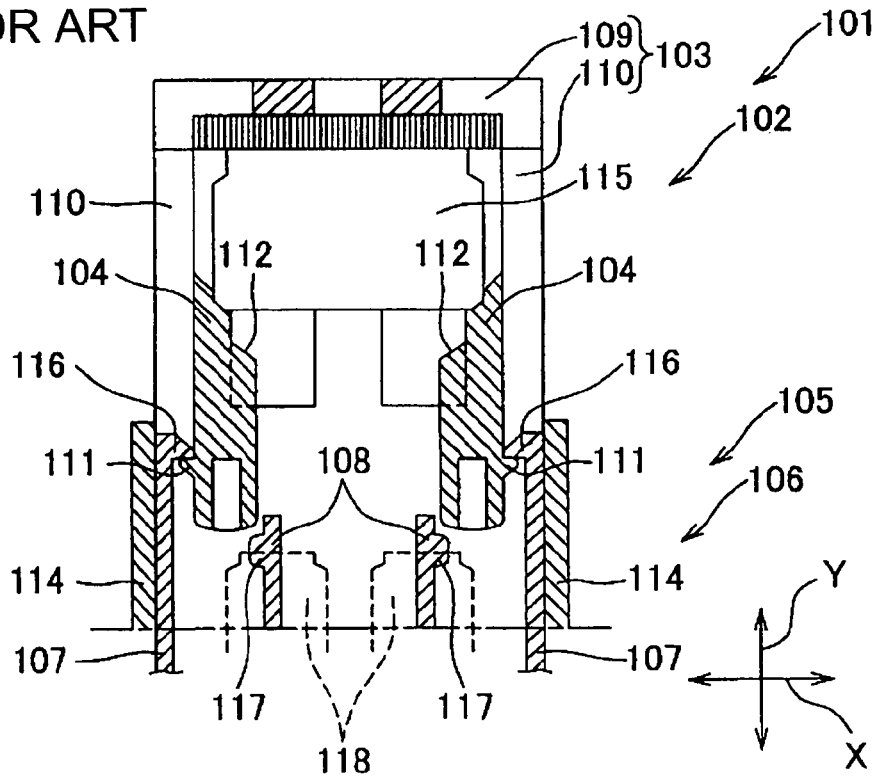
FIG. 10 PRIOR ART
FIG. 10 is an illustration of a mounting structure in a conventional holder, which is a cross-sectional view illustrating the provisional-locking portion brought into locking engagement with the provisional-locking engagement portion.

Referring to FIGS. 6 and 7, the holder 2 is slidably inserted into the accommodating portion 22. The accommodating portion 22 includes (i) a fuse cavity 21*b*, (ii) a pair of leg-accommodating portions 16 to which the pair of legs 4 are connected, respectively; (iii) a complete-locking engagement portion 17 with which the complete-locking portion 12 is brought into locking engagement; and (iv) a provisional-locking engagement portion 18 with which the provisional-locking portion 13 illustrated in FIG. 9 is brought into locking engagement.

The fuse cavity 21*b* includes a fuse accommodating portion 15 adapted to accommodate therein the fuse 11 attached to the holder 2; and a pair of terminal accommodating portion 14 each adapted to accommodate corresponding each of a pair of the tuning-fork-type terminals 20. The pair of terminal accommodating portions 14 are provided such that the fuse accommodating portion 15 is disposed therebetween in the Z-direction.

The fuse accommodating portion 15 takes a shape of a depression extending on the mounting surface 5*b* upon which the fuse 11 of the electrical junction box is mounted. Also, when the complete-locking portion 12 of the holder 2 to which the fuse 11 is attached is brought into locking engagement with the complete-locking engagement portion 18 of the holder mounting portion 5, then the fuse 11 is accommodated in the fuse accommodating portion 15, so that the fuse 11 and the tuning-fork-type terminal 20 passed through the terminal accommodating portion 14 are electrically connected to each other.

The terminal accommodating portion 14 is provided in a straight manner in the Y-direction and extends through the holder mounting portion 5.

The pair of leg-accommodating portions 16 are provided at a position where the fuse cavity 21*b* is positioned therebetween in the Z-direction, and the leg-accommodating portions 16 and the fuse cavity 21*b* (and accordingly its terminal accommodating portion 14) are partitioned by the partition wall 22*a*. Also, the legs accommodating portion 16 includes an inner surface 16*a* adapted to be disposed in an overlapping manner on the outer surface 8*a* of the plate portion 8 in a shape of a recess, and a groove 19 through which the complete-locking portion 12 is passed.

The complete-locking engagement portion 17 protrudes from a bottom portion of the groove 19 provided in a shape of a recess. The complete-locking engagement portion 17 is provided such that the dimension from the top of the protrusion to the surface 16*c* of the partition wall 22*a* opposing the inner surface 16*a* is slightly larger than the thickness of the thick-walled portion 8A (the Z-direction).

The provisional-locking engagement portions 18 are each provided on corresponding each of the pair of inner surfaces 16*b* of the leg-accommodating portion 16, the inner surfaces 16*b* being opposed to the outer surfaces 9*a* of the arm portion 9. The pair of provisional-locking engagement portions 18 are provided at an end of the leg-accommodating portion 16 near an opening, and protrude from the inner surfaces 16*b* in the X-direction and in the direction toward each other. Also, the opening of the leg-accommodating portion 16 is more reduced in dimension than its inner portion by presence of the provisional-locking engagement portion 18. Also, the distance between the pair of provisional-locking engagement portion 18 in the X-direction is slightly larger than that between the outer surfaces 9*a* of the arm portions 9.

Also, there are provided a plurality of fuse cavities 21*a*, 21*c* around the holder mounting portion 5. The fuse cavities 21*a*, 21*c* and the fuse cavity 21*b* (i.e., the accommodating portion 22) are arranged in the X-direction. The fuse cavities 21*a*, 21*c* each include a fuse accommodating portion 15 configured to accommodate therein a fuse (to which the holder 2 is not attached), and a pair of terminal accommodating portions 14 each adapted to accommodate therein the corresponding each of the pair of tuning-fork-type terminals 20.

The following describes how the holder-mounting structure 1 is configured. The fuse 11 is clamped by the pair of clamping portions 6 and the fuse 11 is attached to the holder body 3. The pair of legs 4 are each inserted into the leg-accommodating portion 16, and the holder 2 is slidably inserted into the accommodating portion 22 such that the fuse 11 is moved close to the fuse accommodating portion 15 of the fuse cavity 21*b*. Further, when the holder 2 is further slid in the Y-direction, the tapering portion 13*b* of the provisional-locking portion 13 is brought into abutment on the provisional-locking engagement portion 18. When further slid, the pair of the arm portions 9 are elastically deformed along the tapering portion 13*b* in the direction toward each other, so that the provisional-locking portion 13 goes on the provisional-locking engagement portion 18. When further again slid, the provisional-locking portion 13 goes beyond the provisional-locking engagement portion 18, and the pair of the arm portions 9 are restored to the state before elastic deformation. After that, the second tapering portion 12*b* of the complete-locking portion 12 is brought into abutment on the complete-locking engagement portion 17. At this point, the provisional-locking portion 13 is positioned more inward in the Y-direction than the provisional-locking engagement portion 18 is.

In this manner, the holder 2 is, as shown in FIGS. 5 and 6, positioned at the provisional-locking position of the holder mounting portion 5. Also, in the provisionally locked state where the holder 2 is positioned at the provisional-locking position of the holder mounting portion 5, the fuse 11 attached to the holder 2 is not electrically connected to the tuning-fork-type terminal 20 of the busbar (in the state of electrical disconnection).

Figure 8:
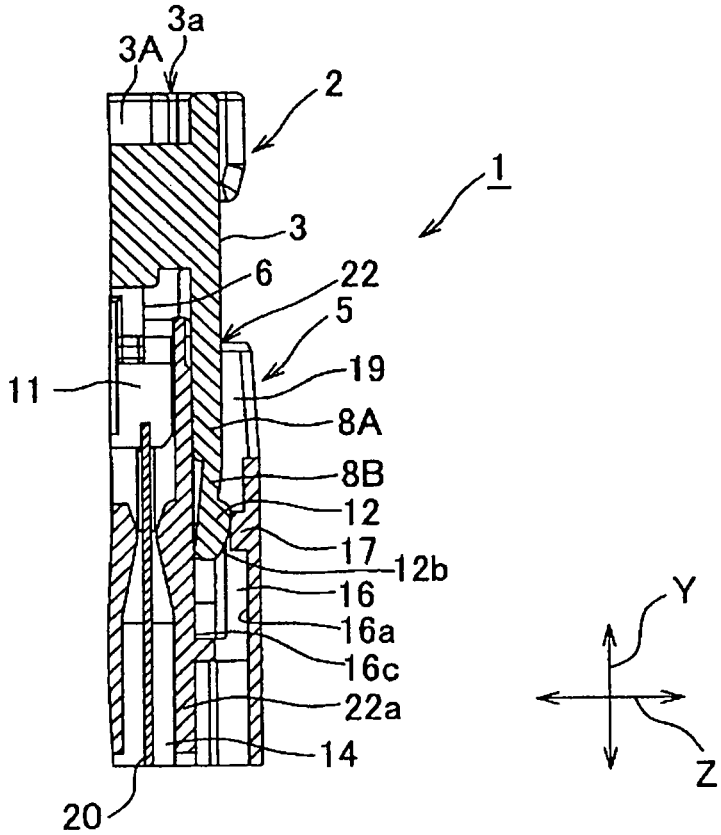
FIG. 8 is an illustration of the holder-mounting structure illustrated in FIG. 1, which is an enlarged view of a principal part thereof in a state where the complete-locking portion is brought into locking engagement with the complete-locking engagement portion.

Next, the following describes the mechanism for connection and disconnection of the fuse 11 attached to the holder 2. In order to electrically connect the fuse 11 attached to the holder 2 and the tuning-fork-type terminal 20 of the busbar to each other, when the top surface 3*a* of the holder body 3 is pressed in the direction toward the holder mounting portion 5 (the Y-direction) in the provisionally locked state where the second tapering portion 12*b* of the complete-locking portion 12 is in abutment on the complete-locking engagement portion 17 and the fuse 11 attached to the holder 2 is not electrically connected to (or disconnected from) the tuning-fork-type terminal 20 of the busbar, then the holder 2 is displaced in the direction toward the holder mounting portion 5, and, as shown in FIG. 8, the pair of thin-walled portions 8B of the pair of plate portions 8 are elastically deformed along the second tapering portion 12*b* of the complete-locking portion 12 and in the direction toward each other, so that the complete-locking portion 12 goes on the complete-locking engagement portion 17. When further pressed, as shown in FIG. 7, the complete-locking portion 12 goes beyond the complete-locking engagement portion 17.

In this manner, when the complete-locking portion 12 goes beyond the complete-locking engagement portion 17, then the pair of thin-walled portions 8B of the pair of plate portions 8 are restored to the state before elastic deformation, and the complete-locking portion 12 is brought into locking engagement with the complete-locking engagement portion 17. Thus, the holder 2 is positioned at the complete-locking position of the holder mounting portion 5, and at the same time, the tuning-fork-type terminal 20 and the fuse 11 are electrically connected to each other.

Also, when electrically disconnecting the fuse 11 attached to the holder 2 and the tuning-fork-type terminal 20 from each other, as shown in FIG. 7, the first tapering portion 12*a* of the complete-locking portion 12 is brought into abutment on the complete-locking engagement portion 17. When, in the complete-locking state where the fuse 11 attached to the holder 2 and the tuning-fork-type terminal 20 are electrically connected to each other, the extended portion 7 is pulled using a pinch in the direction away from the holder mounting portion 5 (the Y-direction) with the extended portion 7 of the holder body 3 trapped by a fingertip, then the pair of thin-walled portions 8B of the pair of plate portions 8 are elastically deformed in the first tapering portion 12*a* and in the direction toward each other, so that the complete-locking portion 12 goes on the complete-locking engagement portion 17. When further pulled, the complete-locking portion 12 goes beyond the complete-locking engagement portion 17. As shown in FIG. 6, when the complete-locking portion 12 goes beyond the complete-locking engagement portion 17, the pair of thin-walled portion 8B is restored to the state before the elastic deformation, and the complete-locking portion 12 and the complete-locking engagement portion 17 are taken out of locking engagement with each other, and at the same time, the tuning-fork-type terminal 20 and the fuse 11 are taken out of the state of electrical connection.

In this manner, the holder 2 is taken out of the complete-locking position of the holder mounting portion 5 and placed in the provisional-locking position.

Also, as shown in FIG. 5, since the provisional-locking portion 13 includes the vertical surface 13*a*, movement of the holder 2 relative to the holder mounting portion 5 is prevented by virtue of abutment of the vertical surface 13*a* on the provisional-locking engagement portion 18 even when the holder 2 is further pulled up in the direction away from the holder mounting portion 5.

When detaching (removing) the holder 2 from the holder mounting portion 5, the holder 2 is positioned at the provisional-locking position of the holder mounting portion 5, and its side on the side of the holder body 3 is more exposed than the provisional-locking portion 13 of the arm portion 9. Accordingly, when the exposed portion of the arm portion 9 is pulled up, the vertical surface 13 of the provisional-locking portion 13 is brought into abutment on the provisional-locking engagement portion 18.

When the pair of the arm portions 9 are further pulled using a pinch in the direction toward each other in a state where the vertical surface 13 of the provisional-locking portion 13 is in abutment on the provisional-locking engagement portion 18, then the pair of the arm portions 9 are elastically deformed along the vertical surface 13*a* and in the direction toward each other, so that the provisional-locking portion 13 goes on the provisional-locking engagement portion 18. When the pair of the arm portions 9 are further pulled in a state where the provisional-locking portion 13 resides on the provisional-locking engagement portion 18, then the provisional-locking portion 13 goes beyond the provisional-locking engagement portion 18. In this manner, when the provisional-locking portion 13 goes beyond the provisional-locking engagement portion 18, the pair of the arm portions 9 are restored to the state before the elastic deformation, and at the same time, the holder 2 is detached (removed) from the holder mounting portion 5.

According to the above-described embodiment, there is provided the holder-mounting structure comprising the holder 2 that includes the holder body 3 to which the fuse 11 as the electric component is attached and the pair of plate portions 8 extending such that the fuse 11 is disposed therebetween; and the holder mounting portion 5 into which the holder 2 is slidably inserted, wherein the holder mounting portion 5 includes the accommodating portion 22 into which the tuning-fork-type terminal 20 as the connecting terminal connected to the fuse 11 is accommodated.

In the above-described holder mounting structure 1, the plate portion 8 includes the thick-walled portion 8A connected to the holder body 3 and the thin-walled portion 8B connected to the thick-walled portion 8A and provided on the end 81 of the plate portion 8 away from the holder body 3, the thin-walled portion 8B being thinner than the thick-walled portion 8A.

The thin-walled portion 8B includes the complete-locking portion 12 configured to be brought into locking engagement with the holder 2 at the position where the fuse 11 is connected to the tuning-fork-type terminal 20 (complete locking) with the holder 2 slodably inserted into the accommodating portion 22.

With the construction and arrangement described above, the thin-walled portion 8B is more readily elastically deformable than the thick-walled portion 8A, and as a result, only the thin-walled portion 8B of the plate portion 8 is elastically deformed so that smaller space is required for elastic deformation than in the case of elastic deformation of the entire plate portion 8. Thus, it is possible to provide a low-profile holder mounting structure 1.

Since the plate portion 8 has a reduced thickness at its thin-walled portion 8B, the mechanical strength of the entire plate portion 8 is ensured.

Also, there is provided the arm portion 9 extending in the first direction (the Y-direction) and spaced from the plate portion 8 and at a position in alignment with the arm portion 9 in the third direction (the X-direction) orthogonal to the first direction (the Y-direction) in which the plate portion 8 upstands and the second direction in which the pair of plate portions 8 are arranged (the Z-direction), and the outer surface 9*a* of the arm portion 9 on the side away from the plate portion 8 includes the provisional-locking portion 13 adapted to be brought into locking engagement with the holder 2 at a position where the holder 2 is slidably inserted into the accommodating portion 22 and the fuse 11 is not connected to the tuning-fork-type terminal 20 (the provisional locking position).

Accordingly, the plate portion 8 is elastically deformable in the second direction (the Z-direction), and the arm portion 9 is elastically deformable in the third direction (the X-direction), and accordingly the plate portion 8 and the arm portion 9 are elastically deformable in two different direction, and thus it is possible to provide a low-profile holder mounting structure 1 with reduced dimension in the second direction in which the plate portions 8 are arranged (the Z-direction).

Also, since the top surface 3*a* of the holder body 3 is flat, it is possible to readily press the holder 2 against the holder mounting portion 5. Also, since the holder body 3 includes the extended portion 7, it is possible to readily pull up the holder 2 from the holder mounting portion 5 by pulling the extended portion 7 using a pinch with the extended portion 7 held by a fingertip.

Also, when replacement of the fuse 11 is necessary, the provisional-locking portion 13 and the provisional-locking engagement portion 18 are taken out of locking engagement by positioning the holder 2 in the provisional-locking position of the holder mounting portion 5 with the exposed portion of the arm portion 9 pulled up by a pinch. In this manner, the holder 2 is detached from the holder mounting portion 5. Thus, the fuse 11 attached to the holder 2 is replaced. Thus, the state of locking engagement of the provisional-locking portion 13 with the provisional-locking engagement portion 18 is exited by simple operation of pulling the pair of the arm portion 9 in the direction toward each other using the pinch, and accordingly the holder 2 is allowed to be detached from the holder mounting portion 5, eliminating use of a tool for exit from locking such as a screwdriver and the fuse 11 can be replaced.

Also, one end of the arm portion 9 on the side of the holder body 3 continues to the holder body 3 or the plate portion 8, and the other end thereof away from the holder body 3 is connected to the plate portion 8, which means that the arm portion 9 is configured to be held at two points, which means that the strength of the arm portion 9 is improved.

In this embodiment, the dimension between the pair of provisional-locking engagement portions 18 in the X-direction is lightly larger than the dimension between the outer surface 9*a* of the pair of the arm portions 9, and there is a gap between the provisional-locking engagement portion 18 and the outer surface 9*a* of the arm portion 9. However, the present invention is not limited to this specific configuration. The provisional-locking engagement portion 18A may includes an abutting portion 18A that is configured to be brought into abutment on the outer surface 9*a* of the arm portion 9 without any gap therebetween as shown in FIG. 9.

Since the provisional-locking engagement portion 18 includes the abutting portion 18A that is brought into abutment on the outer surface 9*a* of the arm portion 9, it is possible by virtue of abutment of the outer surface 9*a* on the abutting portion 18A to prevent unstable contact between the holder 2 and the holder mounting portion 5 in the provisionally locked state. Also, in FIG. 9, the same reference signs are used to denote the same or like elements, and a detailed description thereof is omitted.

Although the electric component of this embodiment is the fuse 11 connected to the dark-current component, the present invention is not limited to this specific configuration. The electric component may be a fuse, a relay or a connector adapted to be connected to the tuning-fork-type terminal 20 which is the connecting terminal (i.e., connected to an electric component other than the dark-current component).

Although, in the complete-locking portion 12 of this embodiment, the outer surface 8*a* of the pair of plate portion 8 on the side away from the fuse 11, the present invention is not limited to this specific configuration. It may be provided on the inner surfaces opposed to each other of the pair of plate portions 8 so as to be brought into locking engagement with the complete-locking engagement portion 17.

Although the complete-locking portion 12 of this embodiment protrudes from the outer surface 8*a*, the present invention is not limited to this specific configuration. The complete-locking portion 12 may take a shape of a recess sized and dimensioned to be brought into locking engagement with the complete-locking engagement portion 17.

Although the holder 2 of this embodiment includes the arm portion 9, the present invention is not limited to this specific configuration. The arm portion 9 may be omitted.

Although, in the holder 2 of this embodiment, the one end of the arm portion 9 on the side of the holder body 3 continues to holder body 3, the present invention is not limited to this specific configuration. The end of the arm portion 9 on the side of the holder body 3 may continue to the plate portion 8.

Although the end of the arm portion 9 on the side of the holder body 3 in this embodiment, continues to the holder body 3 and the other end thereof is connected via the connecting portion 10 to the plate portion 8, the present invention is not limited to this specific configuration. The other end of the arm portion 9 does not need to be connected to the plate portion 8.

Although the tuning-fork-type terminals 20 in this embodiment as the connecting terminal are made in one piece with the busbar, the present invention is not limited to this specific configuration. It suffices that it is a female terminal connected to the busbar or the electric wire.

While the invention has been described in terms of specific embodiments, it will be understood by those skilled in the art that various modifications may be made therein without departing from the spirit and scope of the invention. Also, the terms and expressions which have been employed in this specification are used for description and not for limitation, there being no intention in the use of such terms and expressions of excluding equivalents of the features shown and described or portions thereof. Accordingly, the scope of this invention is only defined and limited by the following claims and their equivalents.

What is claimed is:

1. A holder-mounting structure comprising:

(a) a holder that includes:

(i) a holder body to which an electric component is attached, and (ii) a pair of plate portions extending from the holder body such that the electric component is disposed between the plate portions, the plate portions each including a thick-walled portion continuing to the holder body and a thin-walled portion, thin-walled in the thickness direction, continuing to the thick-walled portion and provided at an end of the plate portion away from the holder body, wherein the thin-walled portion is thinner than the thick-walled portion, the thin-walled portion including a complete-locking portion configured to be brought into locking engagement with the holder; and (b) a holder mounting portion into which the holder is slidably inserted, the holder mounting portion including an accommodating portion into which a connecting terminal to be connected to the electric component is accommodated, wherein the complete-locking portion of the thin-walled portion is brought into locking engagement with the holder at a position where the electric component is connected to the connecting terminal with the holder slidably inserted into the accommodating portion.

2. The holder-mounting structure as set forth in claim 1 further comprising (a) an arm portion extending in a first direction, provided at a position in alignment with the plate portion in a third direction, and spaced from the plate portion, the third direction being orthogonal to the first direction in which the plate portion extend and a second direction in which the pair of plate portions are arranged; and (b) a provisional-locking portion provided on the outer surface of the arm portion away from the plate portion and configured to be brought into locking engagement with the holder in a state where the holder is slidably inserted into the accommodating portion and the electric component is not connected to the connecting terminal.

3. The holder-mounting structure as set forth in claim 2, wherein one end of the arm portion on a side of the holder body continues to either the holder body or the plate portion, and an other end of the arm portion away from the holder body is connected to the plate portion.

4. The holder-mounting structure as set forth in claim 3, wherein the accommodating portion includes an abutting portion configured to be brought into abutment on an outer surface of the arm portion inserted into the accommodating portion, the outer surface being away from the plate portion.

5. The holder-mounting structure as set forth in claim 1, wherein a thin-walled portion is more readily elastically deformed than the thick-walled portion.

6. The holder-mounting structure as set forth in claim 1, wherein thin-walled and thick-walled portions share one common surface in the width direction.

7. The holder-mounting structure as set forth in claim 1 further comprising a pair of provisional-locking portions arranged in a first direction, provided at a position in alignment with the plate portion in a third direction, and spaced from the plate portion, the third direction being orthogonal to the first direction in which the plate portion extend and a second direction in which the pair of complete-locking portions are arranged.

8. The holder-mounting structure as set forth in claim 1 further comprising a provisional-locking portion extending in a first direction, provided at a position in alignment with the plate portion in a third direction, and spaced from the plate portion, the third direction being orthogonal to the first direction in which the plate portion extend and a second direction in which the pair of plate portions are arranged.

9. A holder-mounting structure comprising:

(a) a holder that includes:

(i) a holder body to which an electric component is attached, and (ii) a pair of plate portions extending from the holder body such that the electric component is disposed between the plate portions, the plate portions each including a solid wall having a thick-walled portion continuing to the holder body and a thin-walled portion, thin-walled in the thickness direction, continuing to the thick-walled portion and provided at an end of the plate portion away from the holder body, wherein the thin-walled portion is thinner than the thick-walled portion, the thin-walled portion including a complete-locking portion configured to be brought into locking engagement with the holder; and (b) a holder mounting portion into which the holder is slidably inserted, the holder mounting portion including an accommodating portion into which a connecting terminal to be connected to the electric component is accommodated, wherein the complete-locking portion of the thin-walled portion is brought into locking engagement with the holder at a position where the electric component is connected to the connecting terminal with the holder slidably inserted into the accommodating portion.

* * * * *